United States Patent [19]

Mendicino

[11] 4,273,483

[45] Jun. 16, 1981

[54] DEGLAZING TOOL

[76] Inventor: Lyle J. Mendicino, 130 Jefferson St., North Fond du Lac, Wis. 54935

[21] Appl. No.: 64,009

[22] Filed: Aug. 6, 1979

[51] Int. Cl.[3] ..... B27C 5/10

[52] U.S. Cl. ..... 409/178; 144/136 R; 144/136 C; 409/180

[58] Field of Search ..... 409/175, 178, 180, 181, 409/182; 144/134 D, 136 R, 136 C

[56] References Cited

U.S. PATENT DOCUMENTS

| | | | |
|---|---|---|---|
| 2,452,818 | 11/1948 | Williams | 409/180 |
| 2,676,624 | 4/1954 | Gecmen | 409/178 X |
| 2,988,119 | 6/1961 | Godfrey et al. | 144/134 D X |
| 3,827,468 | 8/1974 | Markham | 144/136 R |
| 4,132,254 | 1/1979 | Shockovsky | 144/136 C |

*Primary Examiner*—William R. Briggs

*Attorney, Agent, or Firm*—Andrus, Sceales, Starke & Sawall

[57] ABSTRACT

A portable deglazing tool for removing glazing compound from window frames while simultaneously refinishing all surfaces preparatory to facilitate reglazing and glass replacement if required. The deglazing is accomplished by a fluted cutting bit with a flat lower end driven from an electric motor at a speed of at least 20,000 r.p.m. and the bit operates through aligned apertures in a base and sub-base with indexing on the tool to set the bit to operate at the location and the depth of the ledge of the window frame.

4 Claims, 10 Drawing Figures

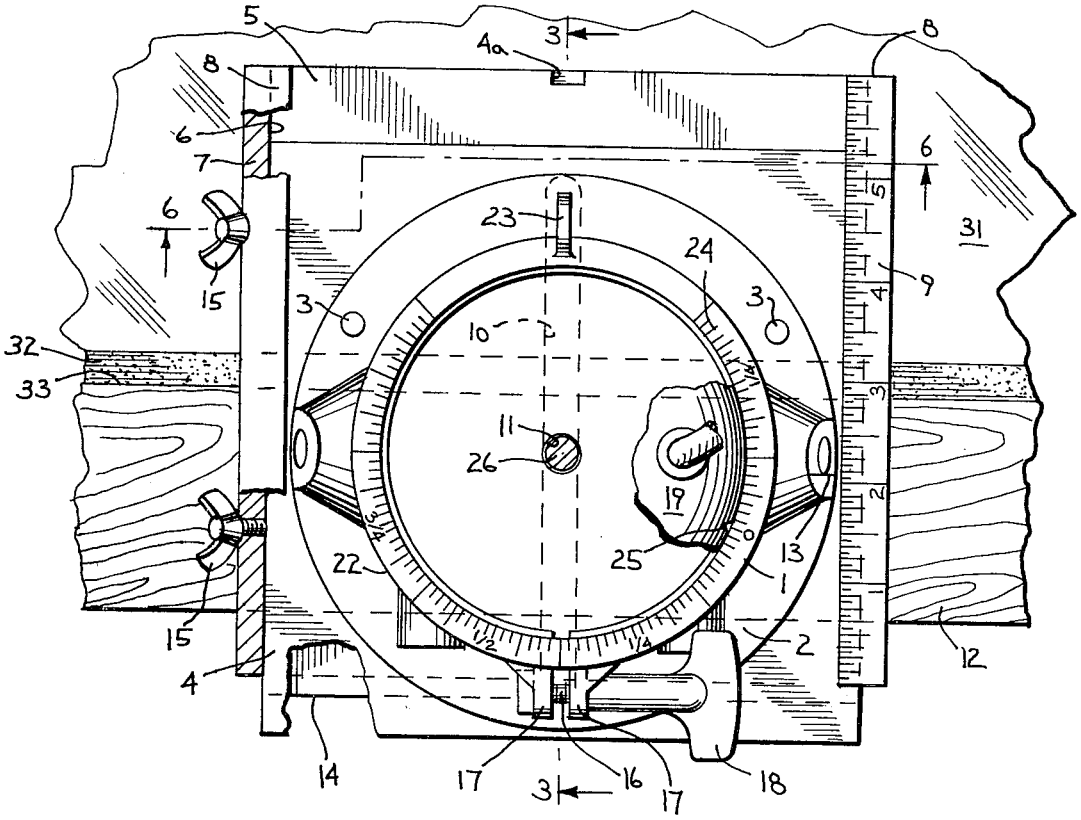
fig. 2
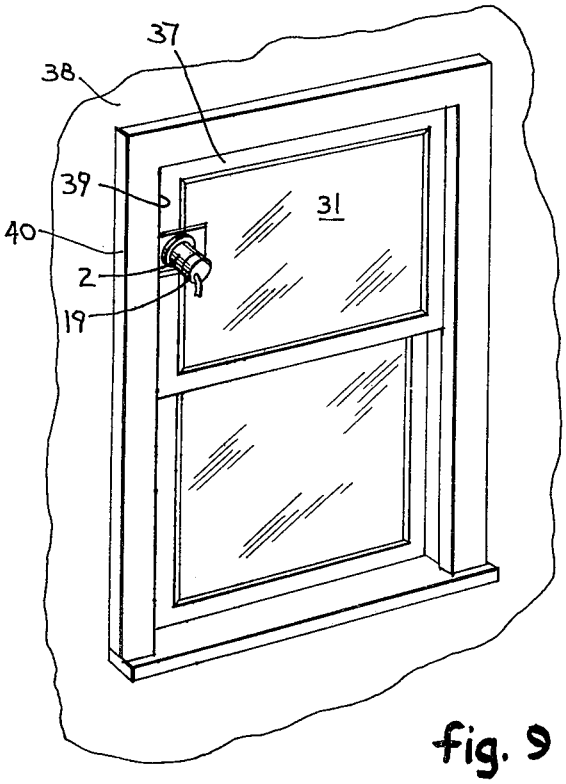
fig. 9
fig. 10
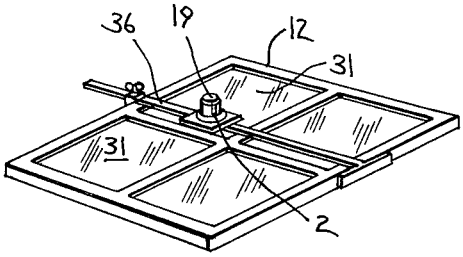

fig. 3
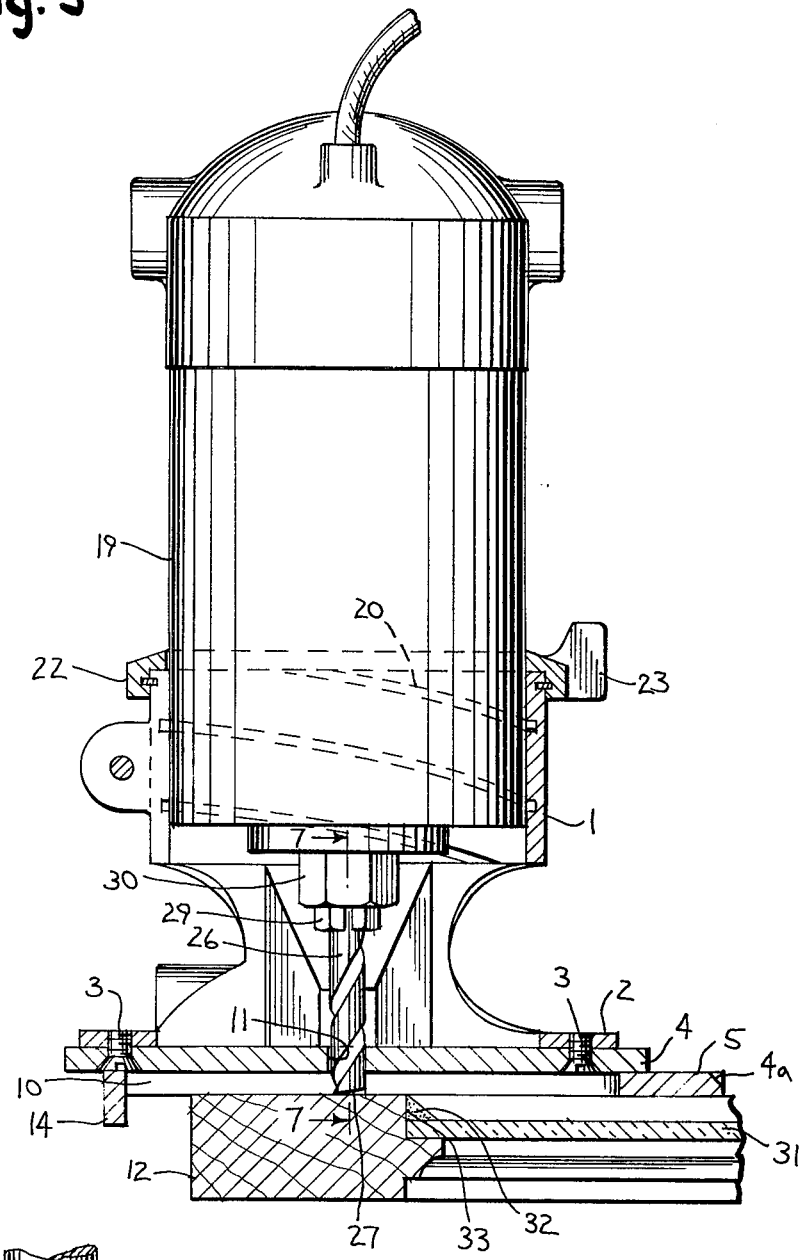
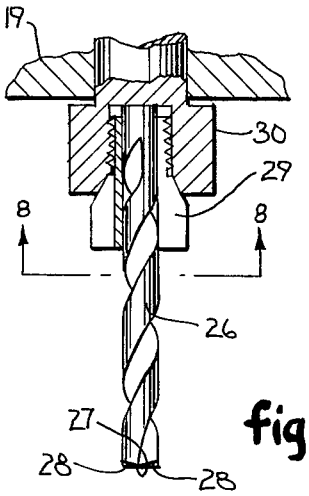
fig. 7
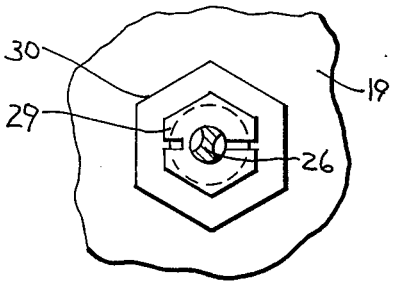
fig. 8

DEGLAZING TOOL

BACKGROUND OF THE INVENTION

The removal of glazing compound from the ledge of a window frame and refinishing the wood surfaces supporting the compound has always presented a problem. A further problem has been the removing of the glazier points so that new points and fresh compound can replace the old points and compound. The invention is directed to a fluted cutting bit for removal of the glazing compound and glazier points and refinishing the supporting wood surfaces of the frame which is driven by an electric motor at a speed of at least 20,000 r.p.m., after an indexed setting of the bit for operation with respect to the location and depth of the ledge of the window frame which is to be deglazed.

SUMMARY OF THE INVENTION

The invention, in general, is directed to a base which is set to overlap the window frame and has a generally central slot which extends at right angles to the frame. Guide members are provided on each side of the base and a sub-base is disposed over the base and is adapted to slide over the base within the guide members. An aperture or hole is provided generally, centrally through the sub-base in alignment with a slot in the base and a fluted cutting bit having a flat lower end extends through the aperture and slot to engage and remove the glazing compound when the cutting bit is finally adjusted with respect to the location and depth of the ledge upon which the glazing compound has been deposited. An electric motor is secured to the upper end of the cutting bit and is rotatable at a speed of at least 20,000 r.p.m. to rotate the bit at a high speed. The motor is connected by an open supporting frame to the sub-base and has an indexing mark thereon which is indexed to a mark on a ruled scale on the base so that when the sub-base is slid over the base to index the mark on the supporting frame to an indexing mark on the base this locates the motor and bit over the ledge to be deglazed.

The motor is rotatable in a cylindrical housing which is secured by the supporting frame to the sub-base and has a helical track on the inside track so that the motor can be rotated to a selected high to set the depth of the cut of the bit of the glazing compound on the ledge which is to be removed. The selected height is obtained by initially measuring the depth of the ledge and the motor is then rotated from a zero position to match an indexing mark on the motor housing with an indexing scale mark on a circular ring around the housing which has been set at the determined depth of the ledge. The deglazing tool is then ready to remove the old glazing compound from the ledge and to refinish the wood surfaces supporting the glazing compound and cut up glazier points.

BRIEF DESCRIPTION OF THE DRAWINGS

The drawings furnished herewith illustrate the best mode presently contemplated by the inventor.

In the drawings:

FIG. 2 is a top plan view with the cutting bit flush against the frame;

FIG. 3 is a section taken on line 3—3 of FIG. 2;

FIG. 7 is a section taken on line 7—7 of FIG. 3;

FIG. 8 is a section taken on line 8—8 of FIG. 7;

FIG. 9 is a perspective view of the deglazing tool in use with a window in place on a building; and FIG. 10 is a perspective view showing the tool in use supported by a spanner when the window being serviced has a narrow frame.

DETAILED DESCRIPTION OF THE INVENTION

Figure 1:
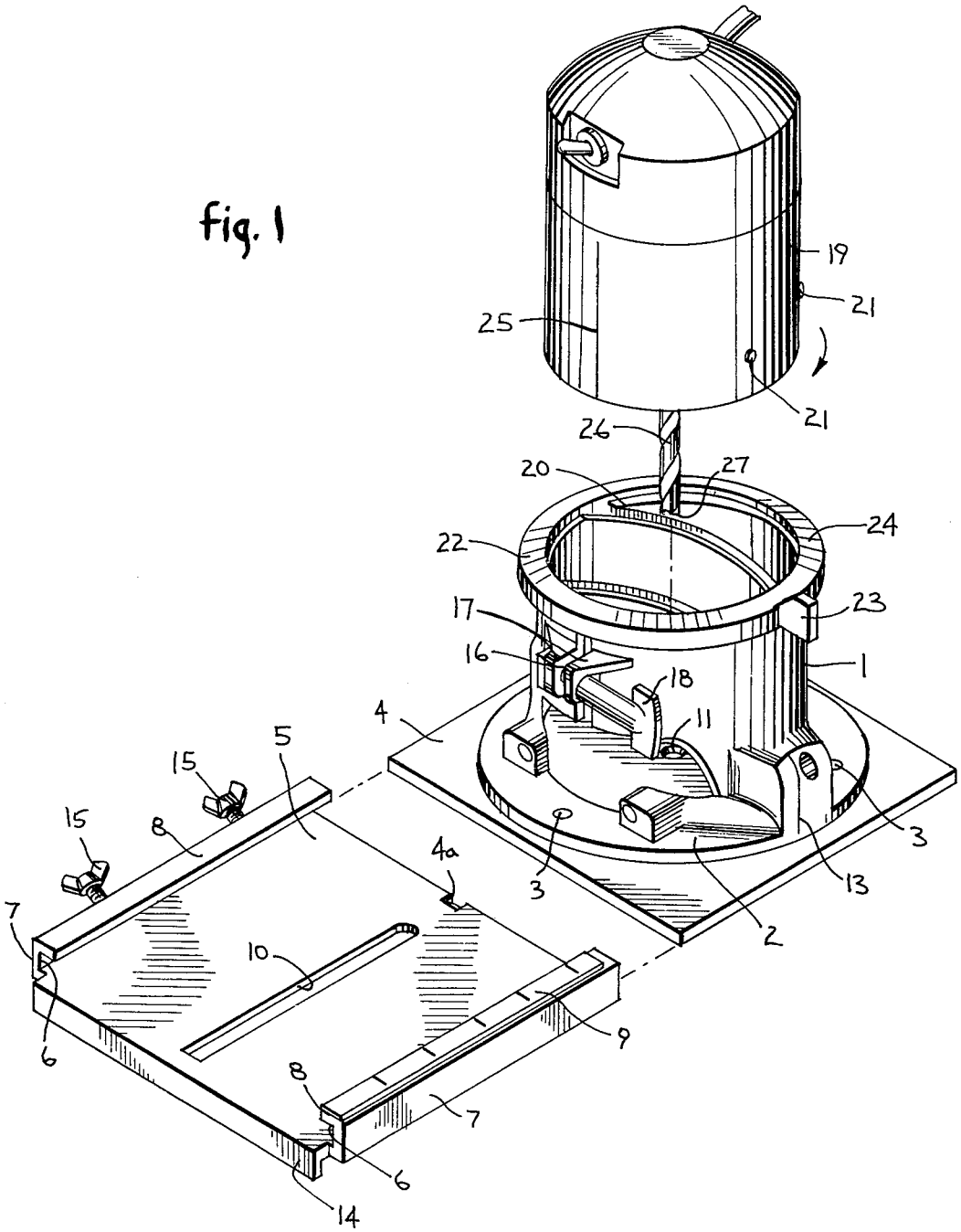
FIG. 1 is an exploded view of the portable deglazing tool of the invention.
Figure 6:
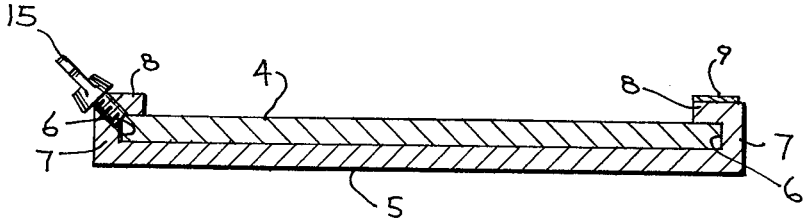
FIG. 6 is a section taken on line 6—6 of FIG. 2 and illustrates the sub-base secured to the base by winged nuts.

Referring to the drawings there is illustrated a deglazing tool which has a housing 1 supported at the lower end on an open circular supporting frame 2, the bottom of which is secured such as by screws 3 to the slide or sub-base 4 which has guide notch 4a to prevent the operator from running the cutting bit into the side of frame 2. Sub-base 4 is slidable over base 5 within slots or guides 6 provided on each side of sub-base 5 by upstanding flanges 7, each of which turns inwardly over sub-base 4 at the upward end 8 to expose a relatively flat surface on the top of the flange. At least one ruled indexing scale 9 is provided on the flat surface of the upper end 8 of one of the flanges 7.

Base 5 has a generally central elongated slot 10 which extends longitudinally of base 5 substantially parallel to upstanding flanges 7. In turn, sub-base 4 has a generally central hole or aperture 11 which is located in alignment with slot 10 in base 5. The deglazing tool is located across a window frame 12 as shown in various figures of the drawings, by sliding movement of the sub-base 4 within slots or guides 6 and over base 5 to establish the positon on frame 12 of the deglazing tool which occurs when the width of the frame measurement as located on indexing scale 9 is aligned with the index mark 13 on the support frame 2 of the housing. Base 5 has a depending flange 14 on the outer end which is lodged into engagement with the outer side of frame 12 to hold base 5 firmly in place when the deglazing tool is being operated. When the selected longitudinal position of the sub-base is obtained a pair of longitudinally spaced wing nuts 15, which extend through one of the upstanding flanges 7 are threaded at an angle of approximately 45° into the base 5 to secure the sub-base 4 to base 5 against horizontal movement within slots 6.

Cylindrical housing 1 above the open supporting frame 2 is split vertically as at 16 and a pair of abutments 17 are secured to housing 1 on opposite sides of the split 16 through which the wing nut assembly 18 extends so that the electric motor 19, which is rotatably disposed within housing 1, can be located at selected vertical positions within housing 1.

The inside of housing 1 has a helical grooved track 20 on the inside within which the abutments 21 ride in turn secured in intermittent helical arrangement to the inside of the main frame of motor 19. Motor 19 may be manually rotated within housing 1 either clockwise or counterclockwise to selected heights within housing 1 and when the selected position is obtained motor 19 is secured against movement by tightening the wing nut assembly 18.

A ruled circular indexing ring 22 is assembled around the upper end of cylindrical housing 1 and is free to be manually rotated by handle 23 to line-up a selected measurement on indexing scale 24 on ring 22 with a second indexing mark 25 on motor 19 to establish and define the location of motor 19 in the housing 1 and the consequent depth of the cutting bit 26 which is held by motor 19 and can be extended downwardly through the aligned hole 11 in sub-base 4 and slot 10 in base 5. Cutting bit 26 is fluted and terminates in the flat bottom 27. Relief angles 28 are provided on the flutes.

FIGS. 3, 7 and 8 illustrate the chucking arrangement for grasping and securing the upper end of cutting bit 26 to motor 19. In the construction thereshown, a split nut 29 encircles the upper end portion of cutting bit 26 and is threaded into a hexagonal shaped member 30 which is secured to the lower end of the shaft, not shown, of motor 19. This permits ready assembly and removal of cutting bit 26.

The operation of the deglazing tool is described as follows, and the assumed measurements are portrayed in the drawings in smaller scale to conserve space.

Assume that the window frame 12 is being prepared for insertion in a window opening in a building, with the glass 31 remaining in the frame but which requires removal of the old glazing compound 32 and replacement with new material.

The first step of the operation of the deglazing tool is to measure the width of window frame 12. If frame 12 is, for example, two and one-eighth ($2\frac{1}{8}$) inches in width then the sub-base 4 is slid within slots 6 so that the two and one-eighth ($2\frac{1}{8}$) inch indexing mark on scale 9 is lined up with the index mark 13 shown in FIGS. 1 and 2 on the supporting frame 2 of housing 1. Sub-base 4 is then secured to base 5 by tightening wing nuts 15. This establishes the horizontal location of the motor 19 with respect to ledge 33 of frame 12.

Next a measurement is made as with a ruler or the like from the top of window frame 12 down the side of ledge 33 which holds the glazing compound 32 to be removed to the glass 31 to thereby obtain the cutting depth of the cutting bit 26.

The depth of the cutting bit 26 is established by setting the deglazing tool on a flat surface such as frame 12, as illustrated in FIGS. 2 and 3, and motor 19 is manually rotated in helical track 20 with the wing nut assembly 18 in loosened position within housing 1, so that cutting bit 26 is initially brought to a zero position. At the zero position, cutting bit 26 will be just touching the flat surface such as frame 12 in FIG. 2 and FIG. 3 of the drawings. When this position of the cutting bit 26 is obtained the wing nut assembly 18 of housing 1 is tightened to thereby hold motor 19 securely in a fixed position within housing 1.

Thereafter, the rotatable indexing ring 22 is rotated on housing 1 by handle 23 to match-up zero on scale 24 of ring 22 with index mark 25 on motor 19. If the depth of the vertical surface of ledge 33 from the top of frame 12 is, for example, one-quarter ($\frac{1}{4}$) of an inch in depth to the glass 31, the wing nut assembly 18 is loosened and motor 19 is rotated clockwise in housing 1 so as to lower motor 19 and cutting bit 26 until the index mark 25 on the motor 19 is aligned with the one-quarter ($\frac{1}{4}$) inch mark on the indexing ring 24. Then motor 19 is secured in housing 1 against rotation by tightening wing nut assembly 18. The deglazing tool is now ready for use with cutting bit 26 located at a cutting depth of one-quarter ($\frac{1}{4}$) of an inch and disposed to extend over the ledge 33 upon which the old glazing compound 32, to be removed, is deposited.

Cutting bit 26 preferably has a diameter of about one-quarter ($\frac{1}{4}$) of an inch and is driven at a speed of 20,000 r.p.m. Because of the speed of the bit, glazier points, such as points 34, are displaced and cut up by cutting bit 26 and even moist glazing compound 32 is readily removed. In addition, the cutting bit leaves about a one-eighth ($\frac{1}{8}$) inch radius 35 in the corners of frame 12, of glazing compound 32 which is readily removable but retained to keep glass 31 from falling out while removing and replacing new glazing compound.

Figure 4:
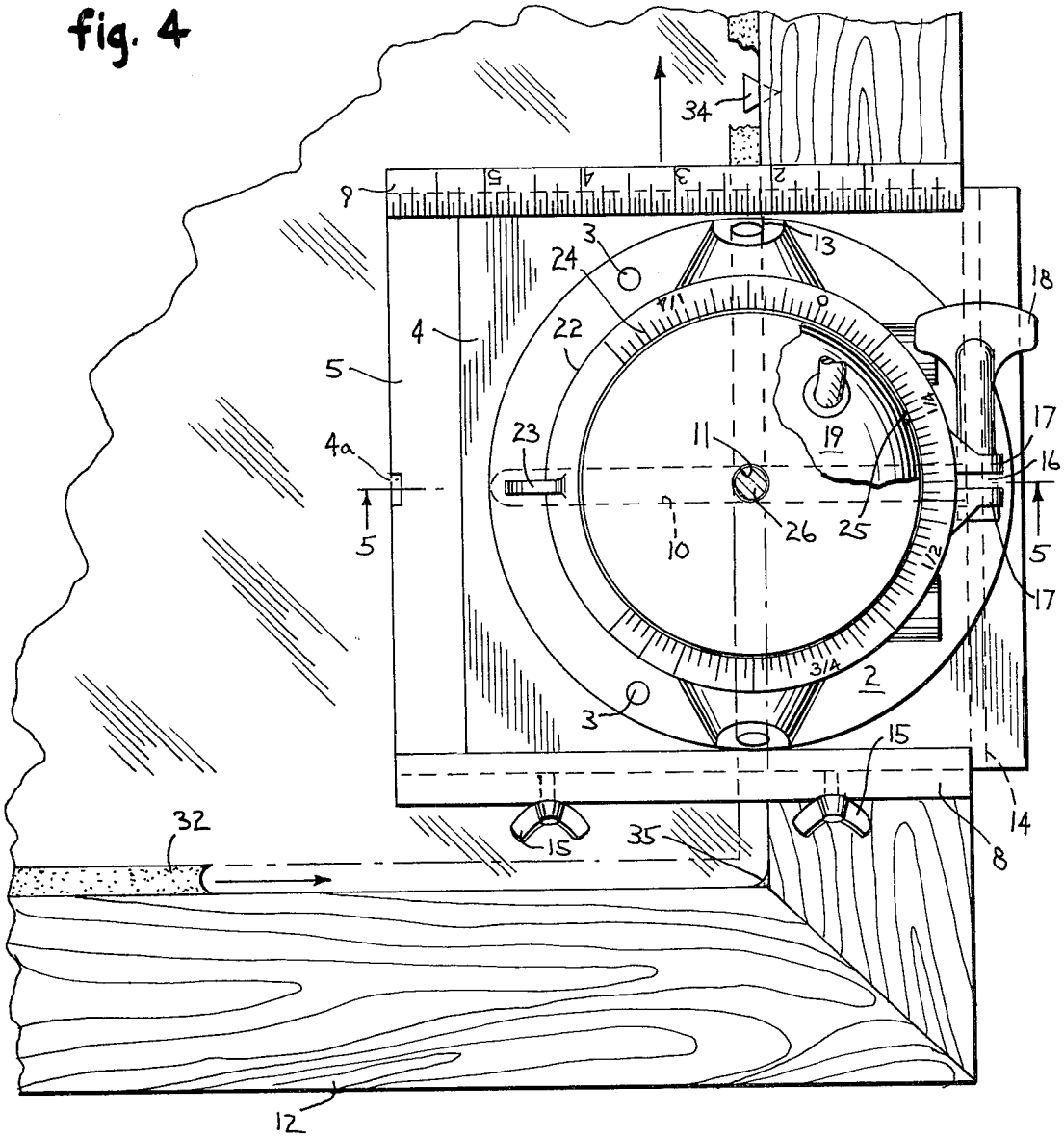
FIG. 4 is a top plan view with the cutting bit in deglazing position.
Figure 5:
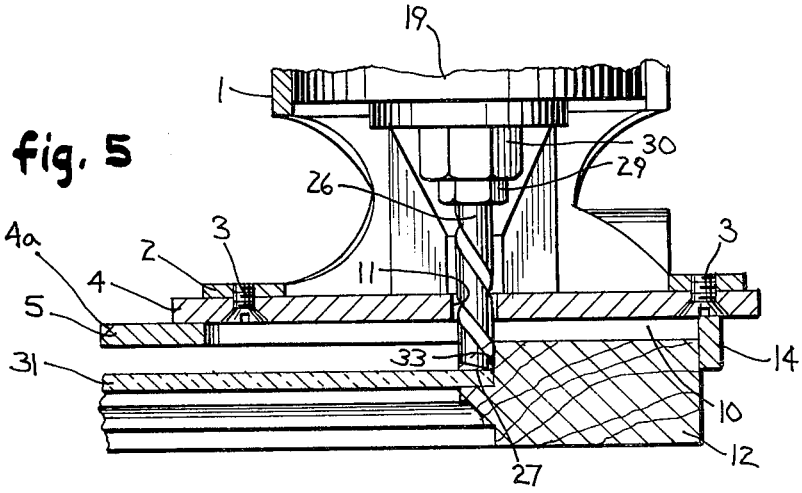
FIG. 5 is a section taken on line 5—5 of FIG. 4 with the cutting bit in deglazing position.

FIGS. 4 and 5 illustrate the deglazing tool in cutting position in which glazing compound 32 has been removed from ledge 33 and the tool has been moved around the corner of window frame 12 and is being actuated to remove the glazing compound 32 from ledge 33 on that side of window frame 12.

Window frame 12, as described and illustrated in FIGS. 1-8, is displaced from a building. FIG. 10 illustrates the use of the deglazing tool with a spanner 36 in the event the width of frame 12 is not sufficient to adequately guide the tool in use.

FIG. 9 illustrates the use of the deglazing tool on a window 37 which is secured in place in a building 38. In this use of the tool, sub-base 4 and base 5 are of smaller construction as is the motor 19 so that the base 5 can be abutted against the strip 39 which borders frame 40 to guide the tool when removing glazing compound 32. In this case, the depending flange 14 on base 5 would be removed.

The deglazing tool is versatile for use on many types of windows to remove glazing compound, destroy glazier points and at the same time refinish the wood surfaces supporting the glazing material. Also it is simple to index and to operate.

Various modes of carrying out the invention are contemplated as being within the scope of the following claims particularly pointing out and distinctly claiming the subject matter which is regarded as the invention.

I claim:

1. A portable deglazing tool for removing glazing compound and glazier points from the inside ledge of window frames while simultaneously refinishing the wood surfaces to which the compound has been applied, which comprises a base disposed to overlie the window frame and having a generally centrally located slot therein extending at right angles to the frame of the window upon which the base of the tool is disposed, guide means located on each side of the base in generally parallel relation to the slot, a sub-base disposed over the base with a central aperture therein in alignment with the slot in the base and adapted to be moved over the base within the guide means, a generally cylindrical housing having an open supporting means at the lower end secured to the sub-base, an electric motor rotatably disposed within the cylindrical housing, a first cooperating indexing means on the supporting means and sub-base which is disposed in predetermined alignment by movement of the sub-base to locate the motor in a selected location longitudinally of the window frame and with respect to the ledge thereof, means to secure the sub-base to the base when the selected alignment of the base and sub-base have been completed and the motor properly located with respect to the ledge, a fluted cutting bit secured at the upper end to the motor within the supporting means and rotated by the motor at a speed of at least 20,000 r.p.m. and adapted to extend through the aperture in the sub-base and the slot in the base to engage the glazing compound on the ledge, and the cylindrical housing being split vertically and having a grooved helical track on the inside, and abutments on the frame of the motor disposed to ride in said track to permit rotation of the motor clockwise or counterclockwise of the motor to locate the motor and cutting bit at various selected heights within the cylindrical housing, the height position of the motor being determined by alignment of a second cooperating indexing means comprising a selected index mark on a rotatable scale on top of the cylindrical housing being aligned with a selected scale mark on the housing of the motor, and a wing nut assembly secured to the two parts of the cylindrical housing and disposed to be tightened to secure the motor within the cylindrical housing in the selected height position to locate the cutting tool over the ledge of the frame at a predetermined depth to then activate the cutting bit and remove the glazing compound and glazing points from the ledge and refinish the wood bordering the ledge without injury to the wood or glass in the event window glass is located on the ledge.

2. The portable deglazing tool of claim 1, and a depending flange provided on one end of the base to engage the inside of a window frame and prevent movement of the tool once it is set for the deglazing operation.

3. The portable deglazing tool of claim 2, the base reversed from normal position to dispose the depending flange inside the frame of the window and the opposite end of the base then abutting the frame of the window to govern movement of the base inwardly and outwardly when the tool has been set for the deglazing operation.

4. The portable deglazing tool of claim 1, and a spanner-like brace secured in place across a window frame when the frame is too narrow to support the tool, and the tool then set for operation on the spanner to accomplish the deglazing operation.

* * * * *